United States Patent [19]

Asselbergs

[11] Patent Number: 4,754,697

[45] Date of Patent: Jul. 5, 1988

[54] PORTABLE FAN DEVICE FOR FORCED AIR HEATING

[75] Inventor: Christophe K. J. Asselbergs, Bragg Creek, Canada

[73] Assignee: Suncourt Holdings Inc., Bragg Creek, Canada

[21] Appl. No.: 940,467

[22] Filed: Dec. 11, 1986

[30] Foreign Application Priority Data

Jul. 9, 1986 [CA] Canada ..... 513385

[51] Int. Cl.[4] ..... F24F 7/007

[52] U.S. Cl. ..... 98/103; 236/49; 417/360

[58] Field of Search ..... 98/39.1, 40.24, 40.27, 98/101, 103, 108; 236/49 D, 49 R; 417/360

[56] References Cited

U.S. PATENT DOCUMENTS

| | | | |
|---|---|---|---|
| 1,426,900 | 8/1922 | Neal | 98/103 |
| 1,645,140 | 10/1927 | Herbruck | 98/101 |
| 1,743,994 | 1/1930 | Waterbury | 98/108 |
| 1,843,786 | 2/1932 | Robinson | 98/103 |
| 1,875,683 | 9/1932 | Waterbury | 98/108 |
| 1,886,841 | 11/1932 | Searles | 98/101 |
| 2,043,934 | 6/1936 | Spear | 98/101 |
| 2,646,744 | 7/1953 | Andrews | 98/108 |
| 2,661,895 | 12/1953 | Frick | 98/94.1 X |
| 2,972,941 | 2/1961 | Bennett | 98/101 |
| 3,035,421 | 5/1962 | Halbeisen | 98/40.24 X |
| 3,099,201 | 7/1963 | Gottlieb | 98/101 |
| 3,985,295 | 10/1976 | Monninger | 236/38 |
| 4,120,615 | 10/1978 | Keem et al. | 417/360 |
| 4,365,930 | 12/1982 | Ogura et al. | 98/40.24 X |
| 4,576,331 | 3/1986 | Harwell | 98/103 X |

FOREIGN PATENT DOCUMENTS

| | | |
|---|---|---|
| 471645 | 2/1951 | Canada . |
| 857627 | 12/1970 | Canada . |
| 947732 | 5/1974 | Canada . |
| 1143210 | 3/1983 | Canada . |
| 1146398 | 5/1983 | Canada . |
| 1181379 | 1/1985 | Canada . |

*Primary Examiner*—Harold Joyce

*Attorney, Agent, or Firm*—Beveridge, DeGrandi & Weilacher

[57] ABSTRACT

A readily portable fan device which is usable both as a cooling fan for circulating ambient air and as a device for increasing the flow of air through a register, comprises a housing containing both a fan impeller and an electric motor for driving the impeller, the housing having a skirt surrounding a bottom air inlet and capable of at least partially sealing a space around such register. Extendable leg means are provided which, when extended, hold the housing skirt clear of a floor and allow the device to draw in air under the skirt when used as a cooling fan.

1 Claim, 3 Drawing Sheets

PORTABLE FAN DEVICE FOR FORCED AIR HEATING

The present invention relates to a fan for use in domestic hot air heating and for cooling.

It has previously been proposed to increase the efficiency of forced air heating systems by use of a fan placed against a wall or floor register to boost the flow of air through the register. A thermostatic control may be provided so that the fan only operates when hot air is being delivered to the register. Most of the prior art proposals require more or less complicated installation and wiring of the device, and do not allow the device to be used as a fan for circulating ambient air within a room.

The present invention provides a readily portable fan device usable either as a cooling fan for circulating ambient air within a room, or as a device for increasing the flow of air through a register, normally a floor register, which may be cool air or heated air depending on requirements. The device requires no special installation.

In accordance with the invention, a fan device comprises a housing containing both a fan impeller and an electric motor for driving the impeller, the housing having a skirt surrounding a bottom air inlet and capable of at least partially sealing a space around the register, and extendable leg means are provided, which, when extended, hold the housing skirt clear of a floor contacted by the leg means and allow the device to draw in ambient air under the skirt when used as a cooling fan.

The extendable leg means may include two shafts each with one part rotatably supported adjacent a bottom of the casing and each having a crank portion connecting the one part to a parallel off-set part which is movable from a position close to the casing bottom to an extended position, and being such that the device can rest with these off-set portions on a floor with the skirt clear of the floor.

The invention will further be described with reference to the accompanying drawings, showing a preferred embodiment, and in which.

Figure 1:
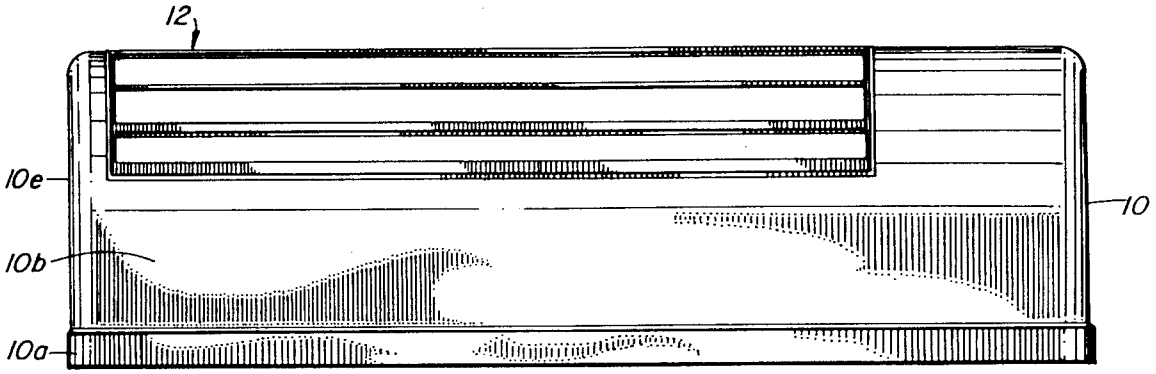
FIG. 1 is a side elevation of the fan device.
Figure 4:
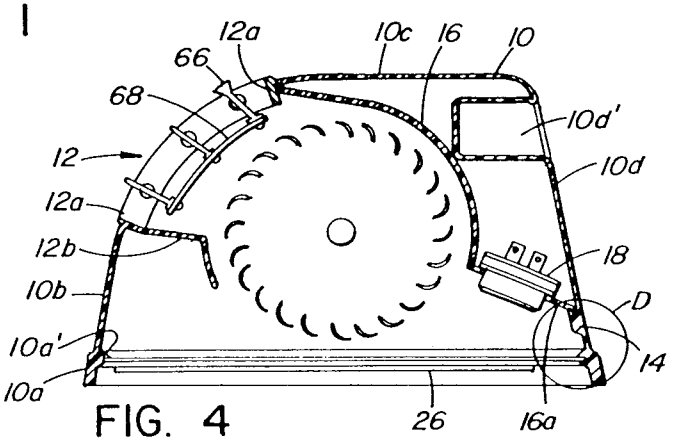
FIG. 4 is a cross-section taken on lines 4—4 of FIG. 3.
Figure 2:
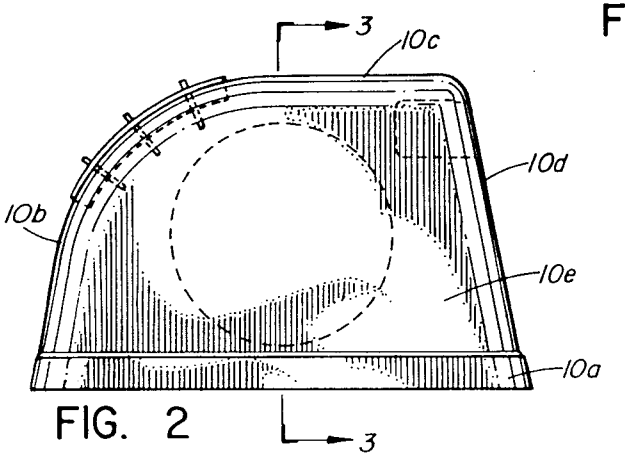
FIG. 2 is an end elevation of the device.
Figure 3:
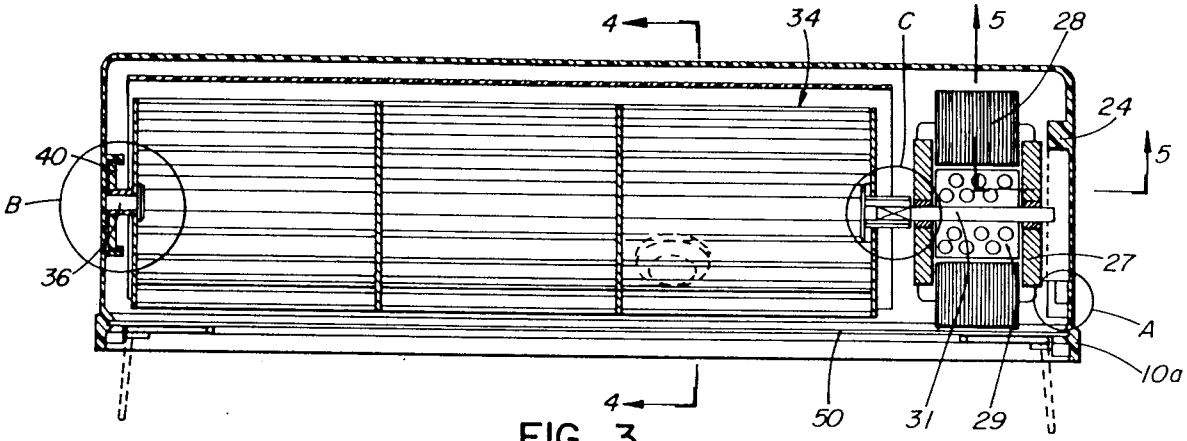
FIG. 3 is a sectional elevation taken on lines 3—3 of FIG. 2.
Figure 5A:
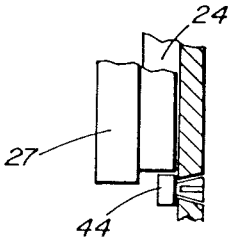
FIG. 5 is a partial section on lines 5—5 of FIG. 3, and showing an electric motor mount.
Figure 6:
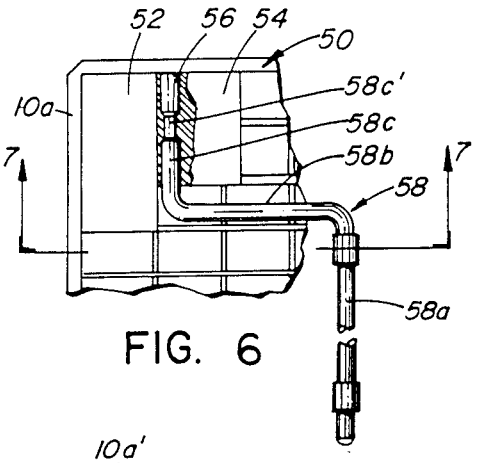
Figure 7:
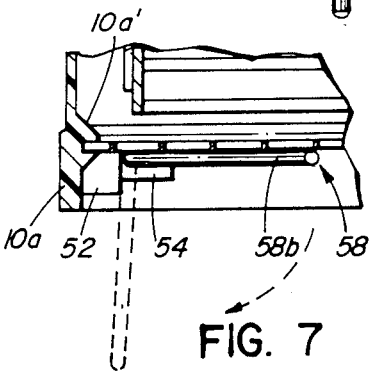
Figure 8:
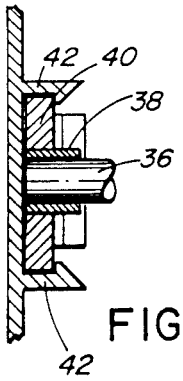
Figure 10:
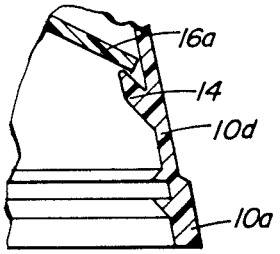
Figure 9:
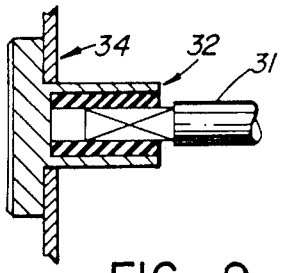

FIG. 5*a* is a detail at A of FIG. 3;

FIG. 6 is a partial view of the underside of a rear corner of the device;

FIG. 7 is a partial sectional view on lines 7—7 of FIG. 6;

FIG. 8 is a detail of parts indicated at B in FIG. 3;

FIG. 9 is a detail of parts indicated at C in in FIG. 3;

FIG. 10 is a detail of parts shown at D in FIG. 4; and

Figure 11:
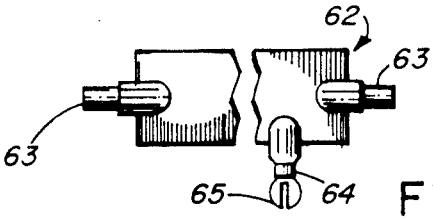

FIG. 11 is a detail view of an adjustable louver.

The main parts of this fan device, apart from the motor and impeller, are made from plastic parts which can easily be snapped together. A first of these parts is a housing 10 which is a hollow molding which may be vacuum formed or injection molded and which is generally rectangular in plan view, having an open bottom surrounded by a thickened skirt 10*a* and having a front

10*b*, a top 10*c*, a rear 10*d*, and side portion 10*e*. This skirt is sized to fit around and form a substantial seal around a typical floor register used as an outlet for heated air in domestic forced air heating systems; typical external dimensions are 29.5 cm by 14.5 cm. A rectangular air outlet 12 having peripheral flange 12*a* is integrally molded in the front 10*b* and also partially in the top 10*c*. The bottom of flange 12*a* has a rear extension formed by a lower guide vane 12*b* which is integrally molded with the remainder of the housing and which has a front horizontal shelf-like portion and a downwardly and rearwardly curving portion at its rear extremity.

The rear 10*d* of the housing has, in its upper part, a recess 10*d*′ of generally rectangular form and which is usable as a hand hold. The lower rear of the housing has a shoulder formed by a longitudinal rib 14, and this cooperates with an internal shoulder provided by the top of peripheral flange 12*a* to retain an upper guide vane 16 which can be snapped into place between these two shoulders. This latter vane has a main cylindrically curved part extending to near the recess 10*d*′. The upper guide vane has a rear part 16*a* which slopes downwardly from the end of the cylindrically curved part and which has an opening in which is retained a thermostatic switch 18. This switch is accordingly positioned near to the air opening within the skirt 10*a* and is exposed to air coming through a register over which the device is placed. Switch 18 may be snap-disc, bi-metallic, or solid state device of readily available type.

Figure 5:
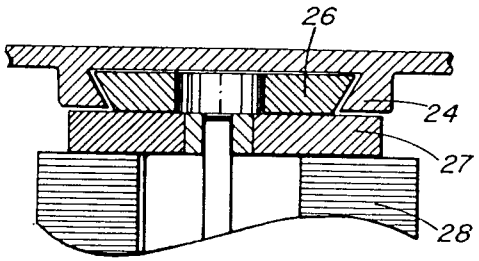

At one end of the casing, as shown, in FIGS. 3 and 5, are internal opposed vertical ribs 24 which together form a dove-tail shaped recess which cooperates to receive a dove-tail part 26 of a motor bearing plate 27, the arrangement being such that the motor can be slid upwardly into place through the bottom opening of the housing. The mounting plate 27 carries the stator part 28 of a conventional electric motor which has a rotor 29. The rotor shaft 31 has an end projecting into a flexible coupling 32, shown in detail in FIG. 9, which is also fixed to the end of tangential fan impeller 34. The outer end of the impeller 34 is supported by a stubshaft 36 which enters a sintered bronze bushing 38 held by an end bearing plate 40. This plate 40 is a snap fit into resilient undercut lugs 42 provided within the side of the housing. These parts are designed for easy assembly, in that with the motor and impeller attached together, the impeller, carrying the bearing plate 40 at the outer ends, can be inserted at an angle with the plate 40 being snapped into place in lugs 42, while at the same time the dove-tail motor bearing plate 26 is slid up into position between the ribs 24. When finally positioned, the motor can be held in place by a motor snap lock 44 shown in FIG. 5*a*.

The motor is connected by cables (not shown) in circuit with the thermostat 18, and with a control switch and indicator light also not shown. The circuit for the motor can also include a timer and/or means for varying the speed of the motor.

In the base of the housing, just above skirt 10*a*, is an inwardly projecting rib 10*a*′ with an inwardly opening groove which can receive, as a snap fit, locking tabs spaced around the periphery of an air intake screen 50. This screen 50, which is also molded of plastics material, has a rectangular grid work of ribs and also has reinforced rear corner parts which carry the extendable legs. As shown in FIGS. 6 and 7, the rear corner of the screen has a reinforcing block 52, on the inner side of which is a smaller block 54 having a fore and aft bore 56 for receiving a leg member 58 formed of steel. Two such leg members are provided, each being in the form of a cranked shaft having a main part 58*a* with a length slightly less than the width of the base, radially extending crank part 58*b*, and an end part 58*c*. This latter part has a central notch 58*c*′ which is designed to be a snap fit within a central reduced diameter portion of the bore 56. The arrangement is such that the part 58*c* can be inserted from the inner side of the bore 56 with the head part of 58*c* snapping in place through the narrow bore section; for this purpose the head may be cross-cut so as to be slightly compressible. The part 58*c* is an interference fit in the bore 56 so that the legs will remain in either the retracted position as shown in FIGS. 3 and 7, or in the extended position as shown in broken lines in these figures The outer position of part 58*b* of these leg means is limited by contact with the part 52.

The side flanges of the air outlet have holes 60 which receive end pivot portions of rotatable louver slats 62, three such slats being provided. As particularly shown in FIG. 11, each slat has a main flat section part and the two end spigots 63, and also has a transversely extending side arm 64 terminating in a connector ball 65. Each of the balls is a snap fit in one of three bores of a tie-rod member 68, which is a slightly curved strip of plastics material which can be snap fitted onto the balls 65 to ensure that the vanes rotate together. For rotation of the vanes, the uppermost of these is provided with a forwardly projecting knurled portion 66.

It will be seen that with this construction, the device can be assembled almost entirely by snapping parts together, most of the parts being moldable of plastics material When being used to supply additional heat from a forced air domestic heating system, the device is placed with its skirt surrounding a floor register with leg members 58 folded, and the thermostat 18 is set at say 35° C., and the control switch is set so that the fan is activated automatically at this temperature. Thus, when the thermostat senses that heat is being supplied to the register the fan becomes operative. The fan not only increases the flow of air through the register, but since the air is flowing faster through the duct system it enters the room at a higher temperature. The device also continues to draw heat from the furnace heat exchanger for a few minutes after the furnace fan has shut down, thus increasing the efficiency of the furnace. If the device has a timer, this can be arranged to supply extra heat only at certain hours.

The device can also be used to increase the cooling effect of a central air conditioning system. In this case, the thermostat is adjusted to close when this senses cooled air being delivered through the register.

Additionally, the device can be used for cooling even where no air conditioning system is used. Firstly, with the device placed over a register, the fan can be operated continuously or intermittently to draw cool basement air through the register and into the room. Alternatively, the device can be used as a personal fan, by the leg members 58 being unfolded to raise the device so that the air inlet is open to the ambient air. The device then operates as an ordinary personal fan.

I claim:

1. A readily portable fan device usable both as a cooling fan for circulating ambient air and as a device for increasing the flow of air through a register, comprising a casing containing both a fan impeller and an electric motor for driving the impeller, said casing having an air outlet and a skirt surrounding a bottom air inlet and capable of at least partially sealing a space around said register, and wherein extendible leg means are provided, which, when extended, hold the casing skirt clear of a floor contacted by the leg means and allow the device to draw in ambient air under the skirt when used as a cooling fan; said extendible leg means including two shafts rotatably supported adjacent the bottom of said casing and having off-set portions movable from a position close to the casing bottom to an extended position.

2. A device according to claim 1, wherein said casing has side portions one of which is provided with a dove-tail groove communicating with the bottom air inlet and wherein said motor has a mounting including a part slidable in said dove-tail groove.

3. A device according to claim 1, wherein sides of said air outlet have holes which support pivots at the ends of rotatable slats which extend across said outlet, each said slat having a transversely projecting operating arm, the arms of each of the slats terminating in a ball member received as a snap fit in a bore of a tie-rod.

4. A device according to claim 1, wherein said impeller is a tangential flow type and wherein said casing is formed of two snap fitted parts, namely a first main outer casing molded from plastics material and having front, top, rear and side portions and defining said air outlet in the front portion, and a second part comprising an upper guide vane extending from adjacent the top of said outlet to the rear bottom of said casing, said second part having edge portions held within internal recesses in said main outer casing.

5. A device according to claim 4, wherein said second part supports a thermostatic switch in circuit with said motor and which is sensitive to air coming from a register when the device is positioned on the register.

6. A readily portable fan device usable both as a cooling fan for circulating ambient air and as a device for increasing the flow of air through a register, comprising a casing containing both a fan impeller and an electric motor for driving the impeller, said casing having an air outlet and a skirt surrounding a bottom air inlet and having edges capable of at least partially sealing a space around said register, the impeller being arranged to direct air generally upwardly through an outlet in the casing when the device is resting on said skirt, said casing having side portions one of which is provided with a dove-tail groove communicating with the bottom air inlet, said motor having a mounting including a part slidable in said dove-tail groove.

7. A readily portable fan device usable both as a cooling fan for circulating ambient air and as a device for increasing the flow of air through a register, comprising a casing containing both a fan impeller and an electric motor for driving the impeller, said casing having an air outlet and a skirt surrounding a bottom air inlet and capable of at least partially sealing a space around said register, and wherein extendible leg means are provided, which, when extended, hold the casing skirt clear of a floor contacted by the leg mens and allow the device to draw in ambient air under the skirt when used as a cooling fan; wherein said casing has side portions one of which is provided with a dove-tail groove communicating with the bottom air inlet and wherein said motor has a mounting including a part slidable in said dove-tail groove.

* * * * *